US006782568B2

(12) United States Patent
Novak et al.

(10) Patent No.: US 6,782,568 B2
(45) Date of Patent: Aug. 31, 2004

(54) JANITORIAL SERVICE SINK EYEWASH

(75) Inventors: Charles J. Novak, Wilmington, DE (US); James F. Fleitz, Hockessin, DE (US); Imants A. Stiebris, Newark, DE (US)

(73) Assignee: Speakman Company, Wilmington, DE (US)

( * ) Notice: Subject to any disclaimer, the term of this patent is extended or adjusted under 35 U.S.C. 154(b) by 0 days.

(21) Appl. No.: 10/465,146

(22) Filed: Jun. 19, 2003

(65) Prior Publication Data

US 2004/0025247 A1 Feb. 12, 2004

Related U.S. Application Data

(60) Provisional application No. 60/390,344, filed on Jun. 20, 2002.

(51) Int. Cl.[7] ..... A61H 33/00; A61H 33/04

(52) U.S. Cl. ..... 4/620; 4/675; 239/16

(58) Field of Search ..... 4/620, 619, 601, 4/675, 676, 900; 239/16, 436, 569, 579

(56) References Cited

U.S. PATENT DOCUMENTS

| | | | | |
|---|---|---|---|---|
| 1,075,373 A | | 10/1913 | Page | |
| 1,230,978 A | | 6/1917 | Anderson | |
| 1,319,738 A | * | 10/1919 | Watrous | 4/515 |
| 1,641,778 A | * | 9/1927 | Overton | 239/533.14 |
| 1,840,812 A | * | 1/1932 | Hardy | 601/155 |
| 2,200,503 A | * | 5/1940 | Held et al. | 4/653 |
| 2,873,999 A | * | 2/1959 | Webb | 239/588 |
| 3,925,829 A | | 12/1975 | Bost | |
| 4,675,924 A | | 6/1987 | Allison et al. | |
| 4,688,276 A | | 8/1987 | Allison et al. | |
| 4,964,573 A | * | 10/1990 | Lipski | 239/283 |
| 5,170,518 A | | 12/1992 | Warriner | |
| 5,530,972 A | | 7/1996 | Tanner | |
| 5,575,424 A | | 11/1996 | Fleischmann | |
| 5,740,569 A | | 4/1998 | Gurries, II et al. | |
| 5,742,961 A | * | 4/1998 | Casperson et al. | 4/615 |
| 5,768,721 A | | 6/1998 | Kersten | |
| 5,823,441 A | | 10/1998 | Nicholson | |
| 5,845,345 A | * | 12/1998 | Ko | 4/678 |
| 5,862,540 A | | 1/1999 | Chuan | |
| 5,911,520 A | | 6/1999 | Kenney | |
| 5,926,868 A | | 7/1999 | Bjerke | |
| 6,058,543 A | | 5/2000 | Thompson | |
| 6,112,342 A | * | 9/2000 | Breda | 4/541.1 |
| 6,151,728 A | | 11/2000 | Wright et al. | |
| 6,256,809 B1 | | 7/2001 | Goldschmidt et al. | |
| 6,276,003 B1 | * | 8/2001 | Knapp | 4/567 |
| 6,296,011 B1 | | 10/2001 | Esche et al. | |
| 6,315,220 B1 | | 11/2001 | Grubb | |
| 6,317,905 B1 | | 11/2001 | Slothower | |
| 6,385,794 B1 | * | 5/2002 | Miedzius et al. | 4/620 |

* cited by examiner

*Primary Examiner*—Gregory L. Huson
*Assistant Examiner*—Huyen Le
(74) *Attorney, Agent, or Firm*—Connolly Bove Lodge & Hutz LLP

(57) ABSTRACT

An emergency washing unit flexibly connected to a service sink faucet, wherein water flow through the unit can be initiated by simply grabbing the unit and squeezing the handle operator on the unit. The unit can be directed anywhere onto the person using it because of its connection to a water supply via a flexible hose. The unit may be mounted on brackets that hold it in a position closer to the user. A vacuum breaker can be used to prevent possible contamination caused by unwanted flow back of used water through the washing unit into the faucet.

7 Claims, 1 Drawing Sheet

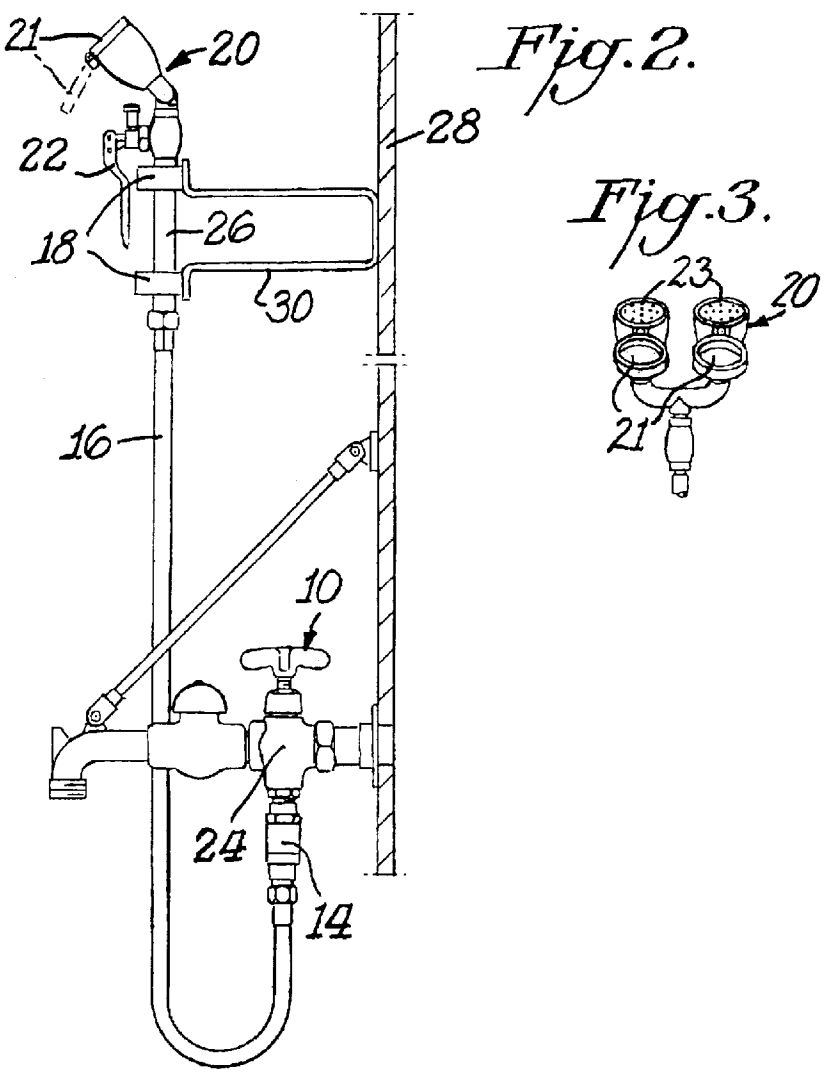
Fig. 2.
28
20
21
22
26
18
30
16
10
24
14
Fig. 3.
20
23
21
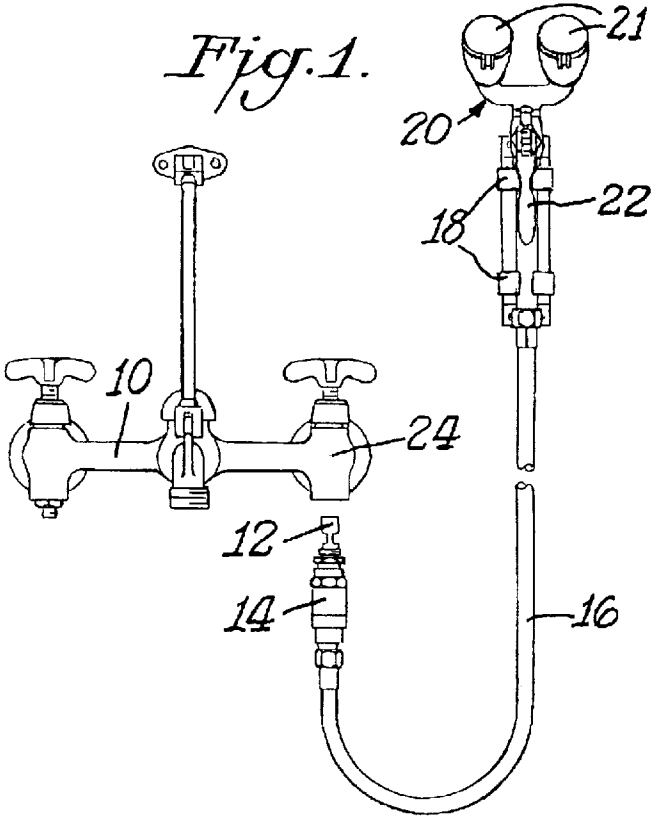
Fig. 1.
21
22
20
18
16
24
12
14
10

JANITORIAL SERVICE SINK EYEWASH

CLAIM FOR PRIORITY

The present application claims priority of U.S. Provisional Patent Application Ser. No. 60/390,344, filed Jun. 20, 2002, the disclosure of which being incorporated by reference herein in its entirety.

BACKGROUND OF THE INVENTION

A. Field of the Invention

This invention relates generally to a service sink system which can be rapidly changed into an apparatus for washing harmful and/or hazardous substances from the body. The system is also designed to prevent contamination of the potable water system by unwanted back flow of non-potable water through the emergency washing apparatus. The service sink environment of this invention is typified by a low sink used by cleaning personnel to wash mops, fill cleaning buckets, and the like. Such sinks usually have faucets arranged above the sink that are a source of hot and cold water used by cleaning personnel. The emergency washing apparatus of this invention is connected to such a faucet.

B. Description of the Related Art

Emergency washing devices are generally known in the art for emergency flushing of hazardous and/or irritating substances from human skin and/or eyes. Some typical arrangements for such devices are described below. None are adapted for use with a service sink faucet.

U.S. Pat. No. 3,925,829 discloses an emergency eyewash fountain apparatus which can be attached to a common sink faucet or laboratory faucet without disturbing its normal use. However, to adjust flow through the emergency eyewash, the user, who is usually blinded by contaminants, must rotate the eyewash spray heads, either horizontally or vertically into a certain position before cleansing water will flow.

U.S. Pat. No. 4,675,924 discloses an emergency eyewash apparatus which maybe attached to the threaded end of a standard kitchen or other faucet. Flow through the eyewash apparatus is enabled by a small pullout knob that would be difficult to operate, let alone locate, in an emergency. A similar arrangement is disclosed in U.S. Pat. No. 4,688,276 granted to the same inventor.

U.S. Pat. No. 5,170,518 describes an eye and body wash fountain apparatus that can be quickly and easily attached to the water outlet nozzle of a standard faucet when the need arises for irrigating the eyes, face and body in case of an accident. However, this apparatus is not normally affixed to the faucet and this must be found and attached to the faucet before it will operate as an eyewash. It thus becomes somewhat impractical in an emergency.

U.S. Pat. No. 5,530,972 describes an eyewash apparatus permanently attached at the side of a sink and equipped with a pair of spray heads. This apparatus is adapted to initiate water delivery when the eyewash spray heads are swiveled laterally, or lowered vertically, from a stored position to an operative position over the sink.

U.S. Pat. No. 5,740,569 describes another eyewash, which is activated by swiveling the eyewash apparatus over a sink.

Common to all of these devices is the fact that the affected body part, including the eyes, must be delivered to the device and never vice versa; and in most of the above-mentioned devices, operation thereof requires location and movement of the device to render flow of water to the affected area of the body.

The related art also includes use of flexible tubing for conveying water from piping to fixtures such as hand held showers. Some examples of flexible tubing used for such purposes are described in U.S. Pat. Nos. 5,823,441; 5,862,540; 5,926,868; 6,058,543; 6,151,728; and 6,315,620. Some of these patents disclose backflow preventers to prevent siphoning of water from the tub to the water supply. Eyewashes attached to flexible tubing have been sold by the assignee of this application, Speakman Company of Wilmington, Del. (Speakman Model Nos. SE920 and 927).

SUMMARY OF THE INVENTION

Accordingly, an object of the present invention is an eyewash janitorial service sink fitting system that is free of all of the above shortcomings.

In the environment of this invention, a service sink is typically located in a janitorial closet, for example, adjacent a bathroom. Cleaning personnel working in and around the sink are often exposed to caustic cleaning chemicals used in their work. The danger exists that such chemicals can splash into the face, eyes or body of cleaning personnel. Thus, the need arises for a device that can quickly treat, i.e., wash off, such chemicals. Thus, it is an object of this invention to provide an emergency washing device that can be readily adapted for use in existing and future janitorial closets having a service sink located therein.

This and other objects of the invention are achieved by arranging a washing apparatus on the end of a flexible hose so it can be grabbed by someone affected by exposure to caustic or hazardous substances. This enables one to instinctively draw the washing apparatus from its holder and towards oneself to douse the affected area of the body.

In a typical service sink area, the sink extends a good distance from the wall of the janitorial closet thereby increasing the difficulty of reaching a fixed washing apparatus located on or near the back wall of the closet. To overcome this problem, in a preferred embodiment of the invention, the eye washing apparatus is mounted on a bracket that extends away from the wall toward the front of the service sink.

To insure consistent availability of water flow to the emergency-washing device, one end of the flexible tubing is attached to the stop cock on the faucet arranged over the service sink. A faucet preferred for use in this invention is a service sink faucet sold by the assignee of this application, Speakman Company of Wilmington, Del. as Model Number SC-5811. Stop cocks in the bottom of the faucet provide access to a cold water supply at all times, thereby providing an ideal arrangement for provision of water for emergency washing.

Preferably, the emergency washing apparatus of this invention is supplied with a vacuum breaker to prevent suction of contaminated water into the potable water system through the emergency washing apparatus. In a preferred mode of the invention, the washing unit, coupled to the cold water cock of the faucet of the service sink fitting, is a hand held dual head eyewash shower with a locking, squeezing handle. A single head eyewash unit is available as well, and could be used, but not as effectively.

Said hand held eyewash unit can be permanently mounted on a wall bracket above and alongside the service sink.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. It is to be understood that both the foregoing general description and the following detailed description are exemplary and explanatory only and are not restrictive of the invention, as claimed.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a front elevational view of the eyewash unit coupled to the service sink faucet via a flexible tube;

FIG. 2 is a side elevational view of the eyewash unit of FIG. 1 illustrating the mounting bracket for the eyewash unit; and FIG. 3 is a fragmental front elevation view showing eyewash nozzles with covers open.

DETAILED DESCRIPTION OF EMBODIMENTS OF THE INVENTION

The following detailed description of the invention refers to the accompanying drawings. The same reference numbers in different drawings identify the same or similar elements. Also, the following detailed description does not limit the invention. Instead, the scope of the invention is defined by the appended claims and equivalents thereof.

Turning now to the drawings and specifically FIGS. 1 and 2, service sink faucet 10, is typically arranged above a service sink in a janitorial closet. The faucet 10 has a cold water valve 24, wherein stop spindle and retaining nut are replaced with a vacuum breaker 14 with a check valve 12. The eyewash unit 20 is coupled to the cold water cock 24 by flexible tubing 16.

FIG. 2 demonstrates both the service sink fitting 10 and eyewash unit 20 as mounted on a wall 28. The eyewash unit 20 is releaseably mounted by the means of a wall mount bracket 30, equipped with retainer arms 18. The length of the bracket 30 enables the eyewash to be positioned closer to the user. The eyewash unit 20 has a grip 26 that is engaged by the retainer arms 18.

According to the preferred mode of the invention, the eyewash unit 20 is equipped with a squeezing handle 22 to activate the eyewash unit 20. When the eyewash 20 is activated by squeezing handle 22, the water pressure will force the nozzle covers 21 open to the phantom position as shown in FIG. 2.

FIG. 3 shows the emergency eyewash nozzles 23 in the activated flow position with nozzle covers 21 fully opened.

A service sink faucet useable with this invention is that offered by the assignee of this invention, Speakman Company, sold as Model Nos. SC-5811 or SC-5811-RCP.

An eyewash unit, particularly suited for use in this invention, is Speakman's Model No. SE-927.

An appropriate check valve for use of this invention is distributed by NEOPERL Incorporated as Model DW10.

When these various parts are assembled, it will appreciated that the vacuum breaker 14 is screwthreaded into the cold cock 24 of the faucet 10, so that the check valve 12 is placed within said cock 24 at the inlet end of the flexible coupling tube 16.

In an emergency, the person in need can pick up the eyewash unit 20 from the retainer clips 18 on the wall 28. By squeezing the handle 22 and holding the unit 20 by the grip 26, water flow through eyewash unit 20 is initiated. When water flows, the pressure in the flexible tube 16 drops and, consequently, check valve 12 moves under the pressure within the faucet cock 24 towards the inlet end of the flexible tube 16. The water flow passes from water supply piping through the cold water cock 24, flexible tube 16 and eyewash unit 20 towards the affected body part. Check valve 12 prevents hot water from entering the eyewash if cold water pressure suddenly drops or is lost in a situation where both hot and cold water valves or faucet 10 are open.

After use, if the affected person leaves the eyewash unit 20 in a place where it contacts with a contaminated water, for example, the service sink, and, at the same time, the water pressure in pipe line by some reason drops, the vacuum breaker 14 is moved in opposite direction, that is towards the pipe line outlet and so closes the passage through the vacuum breaker 14 thereby preventing the dirty liquid from being sucked into the potable water system.

The eyewash unit of this invention provides instant availability to a user who need merely grab the handle 22 and instinctively squeeze it to obtain decontamination. The handle is designated to latch into an open (water flow) position once activated, but can be manually unlatched after decontamination is complete.

It should be understood that the detailed description and specific examples given herein, while indicating preferred embodiments of the invention, are given byway of illustration only, since various changes and modifications within the spirit and scope of the invention will become apparent to those skilled in the art from this detailed description.

What is claimed is:

1. An emergency washing system associated with a service sink faucet comprising a) a water supply b) a service sink faucet including a water inlet and first water outlet, c) at least one valve within the faucet for controlling flow of water from the water inlet to the first water outlet, d) a second water outlet in the faucet in direct communication with the water inlet, e) a hand held eyewash unit containing a water inlet and at least one outlet for discharge of water on a user's body, said eyewash unit including a hand actuatable valve, and f) flexible tubing fluidly connecting the second water outlet of the faucet with the water inlet of the eyewash unit.

2. The portable emergency washing system of claim 1, wherein the service sink faucet is attached to a wall alongside and above a janitorial service sink in a janitorial closet.

3. The portable emergency washing system of claim 2, wherein the hand held eyewash unit is detachably connected on a bracket extending from the wall in the janitorial closet to facilitate access by a user thereof.

4. The portable emergency washing system of claim 1 wherein the hand actuatable valve includes a lever handle to initiate water flow therethrough.

5. The portable emergency washing system of claim 4 wherein the lever handle of the hand actuatable valve is latched into the open position when grabbed by a user of the hand held eyewash.

6. The portable emergency washing system of claim 1 wherein a check valve is located between the second water outlet in the faucet and the inlet of the hand held eyewash unit.

7. The portable emergency washing system of claim 1 wherein a vacuum breaker is located between the second water outlet in the faucet and the inlet of the hand held eyewash unit.

* * * * *